US008479695B2

(12) United States Patent
Ottersbach et al.

(10) Patent No.: US 8,479,695 B2
(45) Date of Patent: Jul. 9, 2013

(54) DEVICE FOR VARYING THE ANGULAR POSITION OF A CAMSHAFT WITH RESPECT TO A CRANKSHAFT OF AN INTERNAL COMBUSTION ENGINE

(75) Inventors: Rainer Ottersbach, Aurachtal (DE); Jürgen Weber, Erlangen (DE); Christoph Betz, Untermembach/Hessdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 365 days.

(21) Appl. No.: 12/884,584

(22) Filed: Sep. 17, 2010

(65) Prior Publication Data

US 2011/0067656 A1 Mar. 24, 2011

(30) Foreign Application Priority Data

Sep. 18, 2009 (DE) ..... 10 2009 042 227

(51) Int. Cl.
*F01L 1/34* (2006.01)

(52) U.S. Cl.
USPC ..... 123/90.17; 123/90.31

(58) Field of Classification Search
USPC ..... 123/90.15, 90.17, 90.31
See application file for complete search history.

(56) References Cited

U.S. PATENT DOCUMENTS

2006/0090719 A1* 5/2006 Imaizumi et al. ..... 123/90.17

FOREIGN PATENT DOCUMENTS

| | | |
|---|---|---|
| DE | 100 54 798 | 5/2002 |
| DE | 10 2004 007 050 | 9/2005 |
| DE | 10 2004 038 695 | 2/2006 |
| DE | 10 2004 062 038 | 7/2006 |

* cited by examiner

*Primary Examiner* — Zelalem Eshete
(74) *Attorney, Agent, or Firm* — Lucas & Mercanti, LLP

(57) ABSTRACT

A device for varying the relative angular position of a camshaft (2) with respect to a crankshaft of an internal combustion engine. The device has a drive element which is driven by the crankshaft via a gearwheel and which is mounted rotatably with respect to the camshaft. Between the drive element and the camshaft, there is at least two hydraulic chambers which can be acted upon with a pressure fluid in order to set a defined relative rotary position between the drive element and the camshaft.

6 Claims, 5 Drawing Sheets

DEVICE FOR VARYING THE ANGULAR POSITION OF A CAMSHAFT WITH RESPECT TO A CRANKSHAFT OF AN INTERNAL COMBUSTION ENGINE

This application claims the priority of DE 10 2009 042 227.7 filed Sep. 18, 2009, which is incorporated by reference herein.

FIELD OF THE INVENTION

The invention relates to a device for varying the relative angular position of a camshaft with respect to a crankshaft of an internal combustion engine, the device comprising a drive element which is driven by the crankshaft via a gearwheel and which is mounted rotatably with respect to the camshaft, there being formed between the drive element and the camshaft at least two hydraulic chambers which can be acted upon with a pressure fluid in order to set a defined relative rotary position between the drive element and the camshaft.

BACKGROUND OF THE INVENTION

Camshaft adjustment devices, in particular those which work hydraulically, are sufficiently known in the prior art. In the hydraulic camshaft adjuster there is an impeller in which vanes are integrally formed or arranged. The vanes are located in hydraulic chambers which are incorporated in an outer rotor. By way of the appropriate action of hydraulic fluid upon the respective side of the hydraulic chambers, an adjustment of the inner rotor (connected to the camshaft) in relation to the outer rotor can take place between "early abutment" and "late abutment". In this case, the flow of hydraulic oil is controlled by an electrically activated directional valve.

In the present case, the transmission of the rotational movement of the crankshaft to the outer rotor takes place via a gearwheel, to which the outer rotor is connected fixedly in terms of rotation. In the prior art, solutions are known in which the gearwheel is designed as a chain wheel and is arranged on the outer circumference of the outer rotor or is connected fixedly in terms of rotation to the outer rotor. Examples of this are disclosed in DE 100 54 798 A1, in DE 10 2004 007 050 A1, in DE 10 2004 038 695 A1 and in DE 10 2004 062 038 A1.

The axial mounting of the camshaft in the cylinder head mostly takes place in that, first, a camshaft end is connected to the inner rotor of the camshaft adjuster by means of a central screw or by welding. The axial mounting of the inner rotor in the camshaft adjuster consequently then also ensures the axial mounting of the camshaft. The transmission of the drive torque to the outer rotor takes place by means of said gearwheel.

The gearwheel, designed as a spur wheel, presents serious disadvantages for grinding processes on account of its undercut between the end face of the gear ring and the outer end face of the sealing cover of the adjuster: if the tooth flanks are to be ground in order to achieve a sufficient toothing quality, the grinding tool rundown necessary for manufacturing purposes is no longer possible.

OBJECT OF THE INVENTION

The object on which the present invention is based is to develop a device of the type initially mentioned such that it becomes possible that the required parts and, in particular, the toothing of the gearwheel can easily be produced in high quality.

SUMMARY OF THE INVENTION

The solution for achieving this object by means of the invention is characterized in that the drive element has at least one cover arranged on the end face, the gearwheel being axially adjacent to the cover and being connected to the latter positively and/or in a materially integral manner.

Especially preferably, a multispline connection or multitooth connection is formed between the cover and the gearwheel. The multispline connection may in this case have a number of splines or teeth which extend radially outward and which are arranged on the gearwheel and extend into matching recesses in the cover. The multispline connection may in this case have an axial fixing between the gearwheel and cover in the form of at least one plastic deformation which is introduced into the splines or teeth and/or into the recesses.

Alternatively, it is also possible that the gearwheel and the cover are connected to one another positively by means of a snap ring.

Furthermore, there is the possibility that the gearwheel and the cover are connected to one another positively by means of a flanged portion of the gearwheel.

The cover may be connected to the drive element by means of a screw connection.

The gearwheel, preferably designed as a spur wheel, and the sealing cover are configured in two parts. For transmitting the drive torque, the connection between the sealing cover and gearwheel is preferably in the form of a multitooth profile with a form fit. The tooth play of this connection by multitooth form fit may be removed by means of an axial plastic deformation of the form fit profile on the gearwheel in the already assembled form bond.

The spur wheel may be produced as an individual part with high manufacturing quality by forming, abrasion, sheet-metal laminating, forging, casting, sintering, compacting, hardening, grinding or in a similar way. By the gearwheel being formed separately, its toothing can easily be machined.

The sealing cover constitutes a ring-like component with screw bores or threads for making a screw connection to the stator of a camshaft adjuster. The cover may be produced by forming, stamping, abrasion, forging, casting, sintering, grinding, turning or in a similar way.

The gearwheel designed as a spur wheel may be provided on one end face with a toothed hub, this toothing engaging radially into a matching profile on the inside diameter of the sealing cover and thus making a positive connection between the gearwheel (spur wheel) and the sealing cover for the purpose of transmitting the drive torque from the spur wheel to the stator of the camshaft adjuster.

After the two toothed components, namely the gearwheel and the sealing cover, have been joined axially, manufacturing tolerances leading to play in the toothing can be eliminated by carrying out plastic deformation on the cooperating toothing or recess. This may take place by means of a special tool. A play-free form fit between the spur wheel and the sealing cover is thereby ensured.

It is also possible that the tooth play occurs due to radial widening on the inside diameter of the toothed hub, and this may take place by means of a spreading tool. The use of a pressed-in widening sleeve is also possible in this case.

Said form fit may also be made on the end face between the hub portion of the gearwheel and the sealing cover. In this case, the spur wheel is inserted axially into the sealing cover until the end-face toothing on the hub engages axially, free of play, into the end-face countertoothing in the sealing cover. In this case, the spur wheel is guided by means of an additional centering of the hub with respect to the inside diameter of the sealing cover and is fixed in this centering in the axial direction by means of a transverse press fit. An additional safeguard against microcreep is also possible in this case by adhesive bonding.

Owing to the two-part design of the spur wheel and sealing cover and to the positive connection between the spur wheel and sealing cover, the weight and costs of the camshaft/camshaft adjuster system can be reduced, and high quality requirements placed upon the toothing of the gearwheel can be met.

BRIEF DESCRIPTION OF THE FIGURES

Exemplary embodiments of the invention are illustrated in the drawings in which.

DETAILED DESCRIPTION OF THE FIGURES

Figure 1:
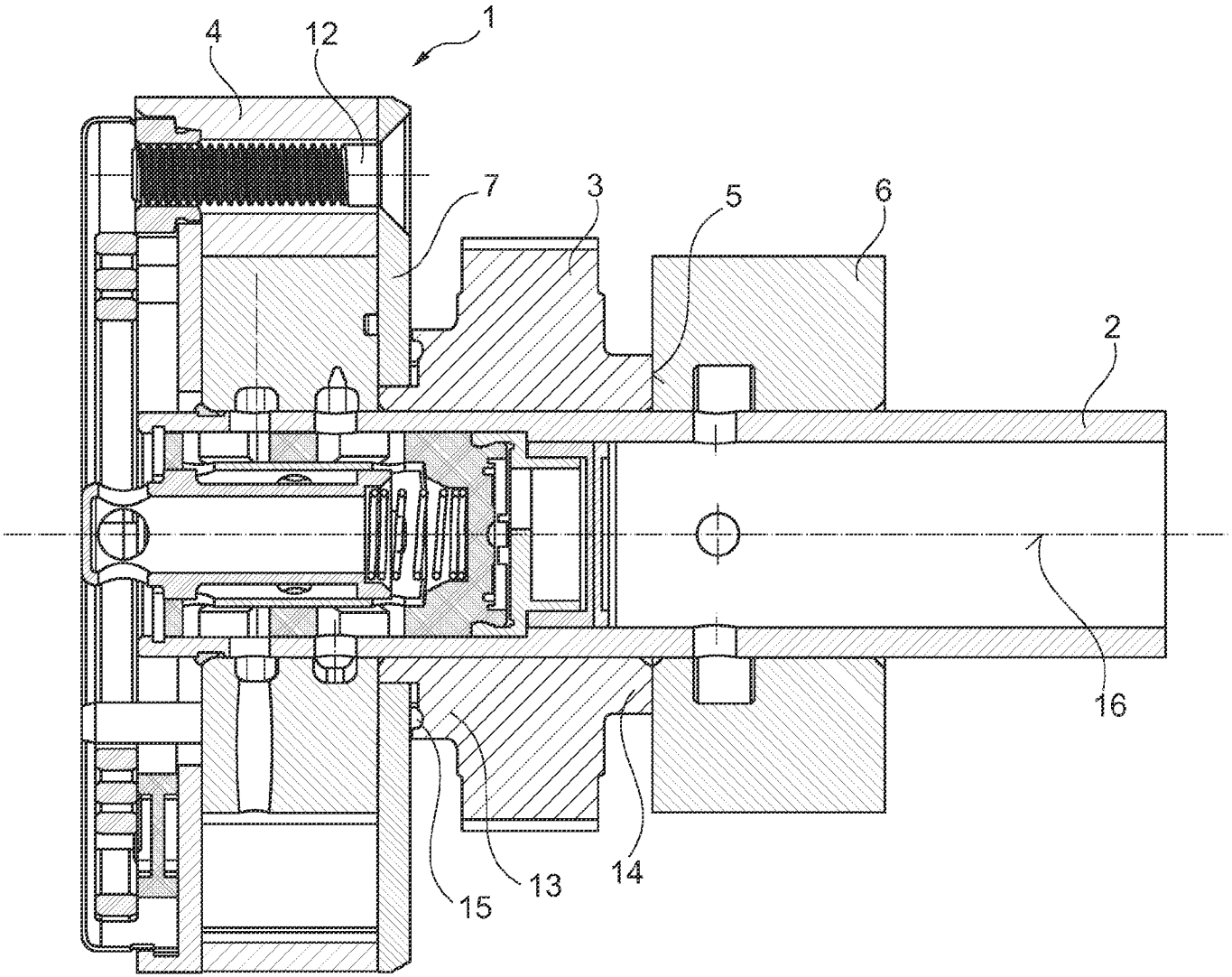
FIG. 1 shows a radial section through a device for varying the relative angular position of a camshaft with respect to a crankshaft of an internal combustion engine, that is to say of a camshaft adjuster.
Figure 3:
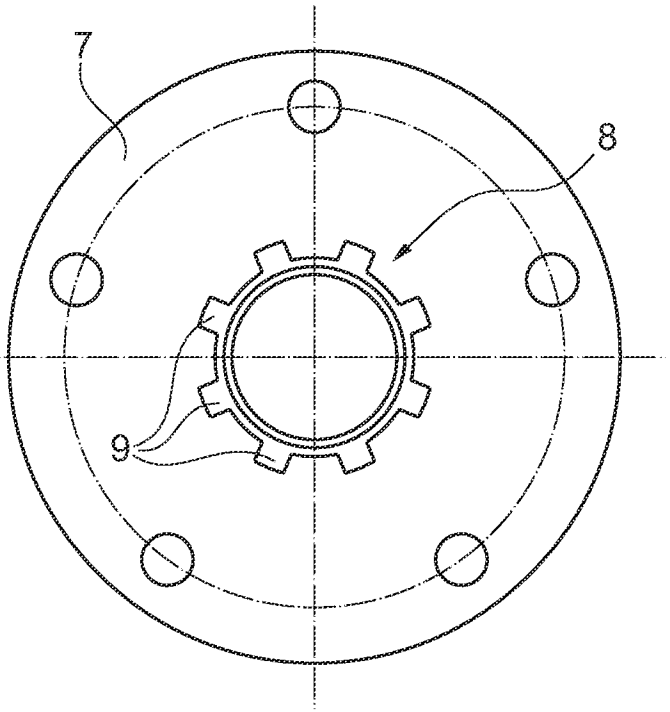
FIG. 3 shows the cover of the camshaft adjuster, together with the gearwheel, in the view "C" according to FIG. 2.
Figure 2:
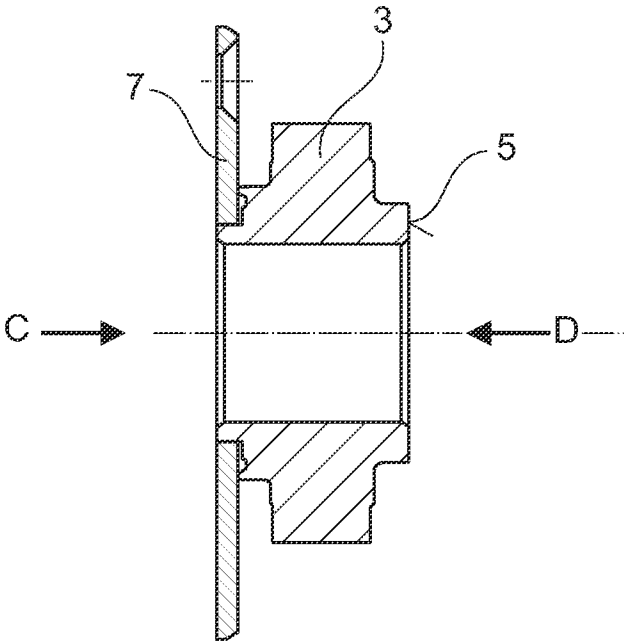
FIG. 2 shows a radial section through a cover of the camshaft adjuster, said cover being connected to a gearwheel of the camshaft adjuster.
Figure 4:
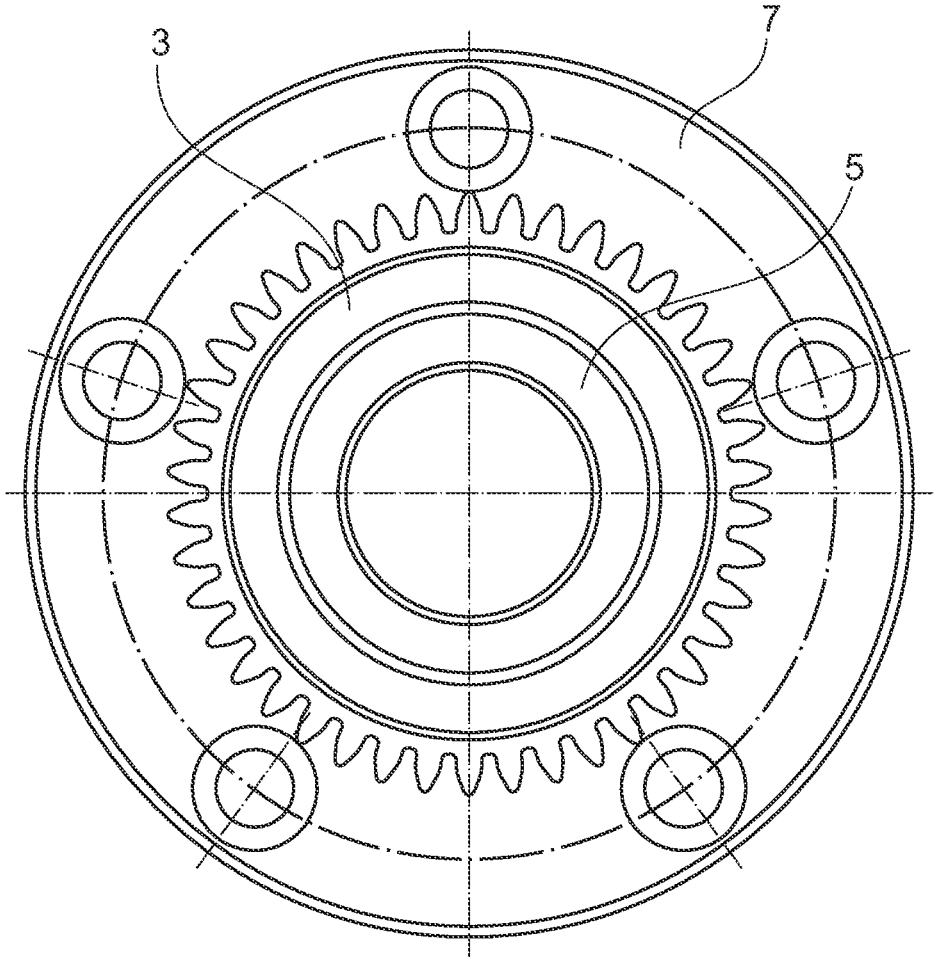
FIG. 4 shows the cover of the camshaft adjuster, together with the gearwheel, in the view "D" according to FIG. 2.
Figure 6:
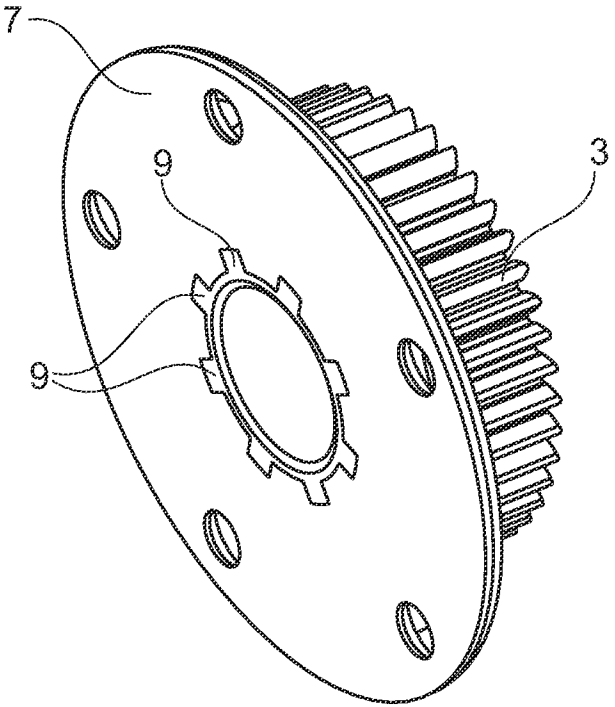
FIG. 6 shows the cover of the camshaft adjuster, together with the gearwheel, according to FIG. 2 in a perspective view, the viewing direction being changed as compared with FIG. 5.
Figure 5:
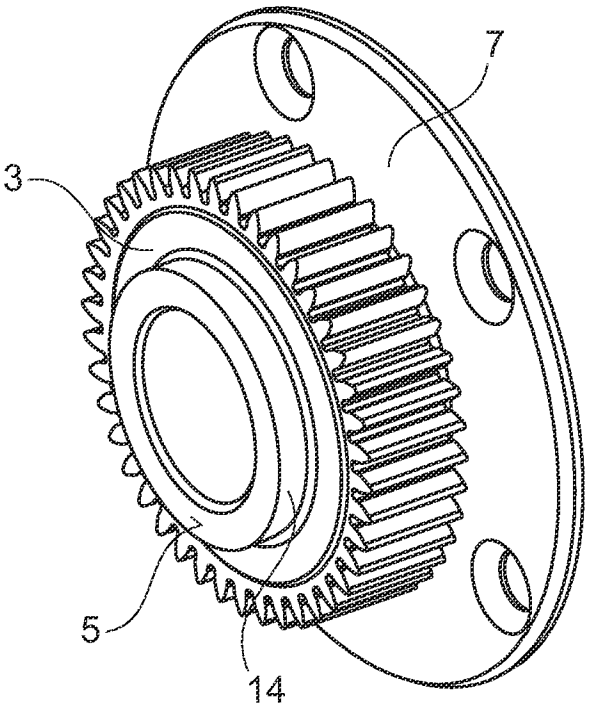
FIG. 5 shows the cover of the camshaft adjuster, together with the gearwheel, according to FIG. 2 in a perspective view.

FIG. 1 illustrates a device 1 (camshaft adjuster) for varying the relative angular position of a camshaft 2 with respect to a crankshaft (not illustrated) of an internal combustion engine. The camshaft 2 rotates about an axis of rotation 16. An essential component of the device is a drive element 4 into which is incorporated a hydraulic adjustment means which can bring about angular rotation between an outer annular part (stator) and the camshaft 2 (rotor), in order to influence the control times of the internal combustion engine in a known way.

For this purpose, hydraulic chambers (which cannot be seen in more detail) are arranged so as to act in pairs between the drive element 4 and the camshaft 2 and can be acted upon with pressure fluid so that said rotation can be set. A plurality of these pairs of hydraulic chambers are present over the circumference.

The drive element 4 is in this case coupled fixedly in terms of rotation to the crankshaft. This rotary coupling is provided by a gearwheel 3 which, in the present case, is designed as a spur wheel and is connected fixedly in terms of rotation to the stator. More specifically, the spur wheel 3 is connected fixedly in terms of rotation to a cover 7; the cover 7 is fastened to the stator via a screw connection 12. The spur wheel 3 carries on its outer circumference a toothing (not illustrated) which is in engagement with a mating gearwheel which is connected fixedly in terms of rotation to the crankshaft. The rotational movement of the crankshaft is therefore transmitted to the drive element 4 (stator) via the gearwheel 3 and the cover 7.

It is essential that the gearwheel 3, on its end face facing away from the camshaft adjuster 1, forms a bearing surface 5 for the axial run-on of the camshaft 2 or of a component 6 connected fixedly in terms of rotation to the latter. In the present case, the camshaft 2 is fixedly connected to a component 6, so that the component 6 can run on the bearing surface 5, thus providing the camshaft 2 with axial mounting on the camshaft adjuster 1.

It is essential, furthermore, that a drive torque for the drive element 4 can be transmitted between the gearwheel 3 and the cover 7. As may be gathered from the further FIGS. 2 to 6, in the exemplary embodiment outlined there there is provision for the gearwheel 3 to be composed of a hollow-cylindrical basic body to which hollow-cylindrical portions 13 and 14 are contiguous in the two axial end regions (see FIG. 1). In the present case, a defined axial bearing surface of the gearwheel 3 on the cover 7 is provided in that a lathe-turned indentation 15 resembling an annular groove is incorporated into that end face of the hollow-cylindrical portion 13 which bears against the cover 7.

Referring to FIGS. 2 to 6, it can be seen that torque transmission between the gearwheel 3 and the cover 7 takes place by means of a multispline connection 8. Accordingly, the hollow-cylindrical portion 13 has in its axial end region splines 9 which extend radially outward and engage positively into matching recesses in the cover 7 (see FIG. 3 and FIG. 6).

Figure 7:
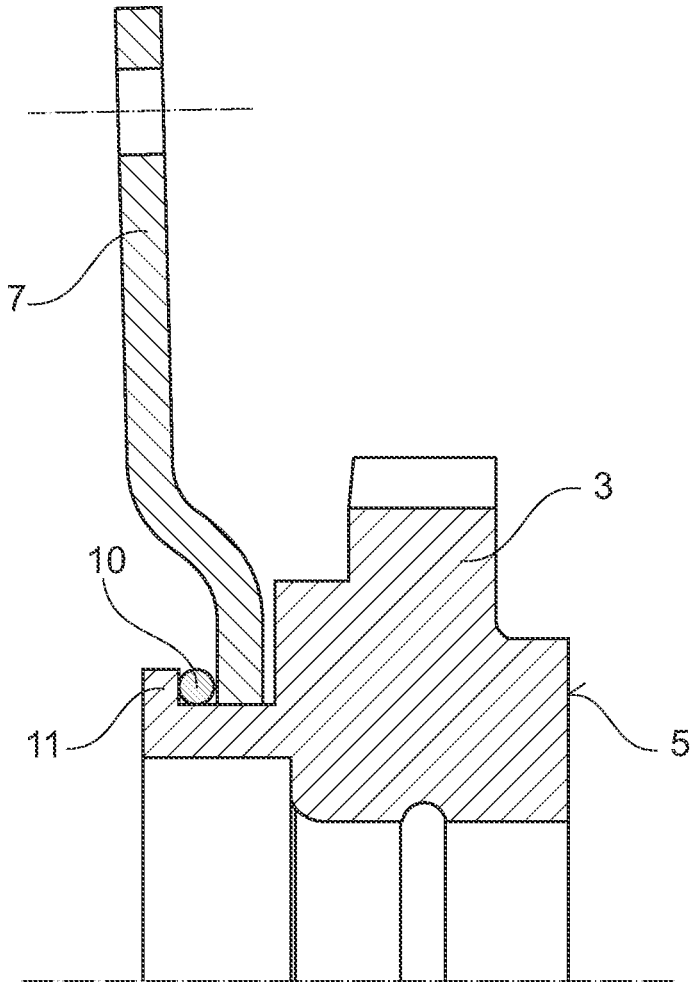
FIG. 7 shows a radial section through the cover of the camshaft adjuster, together with the gearwheel, in an alternative embodiment of the invention.

An alternative possibility for fastening between the gearwheel 3 and the cover 7 is outlined in FIG. 7. Here, a snap ring 10 is used, which is arranged in a recess which resembles an annular groove and is formed by a flanged portion 11.

A camshaft adjuster with an axial bearing for the camshaft between the spur wheel 3 and the cylinder head can consequently be implemented simply and cost-effectively.

LIST OF REFERENCE SYMBOLS

1 Device (camshaft adjuster)
2 Camshaft
3 Gearwheel
4 Drive element
5 Bearing surface
6 Connected component
7 Cover
8 Multispline connection/multitooth connection
9 Splines/teeth
10 Snap ring
11 Flanged portion
12 Screw connection
13 Hollow-cylindrical portion
14 Hollow-cylindrical portion
15 Lathe-turned indentation
16 Axis of rotation

The invention claimed is:

1. A device for varying the relative angular position of a camshaft with respect to a crankshaft of an internal combustion engine, the device comprising:

a drive element which is driven by the crankshaft via a gearwheel and which is mounted rotatably with respect to the camshaft, there being formed between the drive element and the camshaft, at least two hydraulic chambers which can be acted upon with a pressure fluid in order to set a defined relative rotary position between the drive element and the camshaft, wherein the drive element has at least one cover arranged on an end face, the gearwheel being axially adjacent to the cover and being connected to the cover by a multispline connection or a multitooth connection, wherein the multispline connection or the multitooth connection has a number of splines or teeth which extend radially outward and which are arranged on the gearwheel and extend into matching recesses in the cover, and wherein the multispline connection or the multitooth connection has an axial fixing between the gearwheel and cover in a form of at least one plastic deformation which is introduced into the splines or teeth and/or into the recesses.

2. A device for varying the relative angular position of a camshaft with respect to a crankshaft of an internal combustion engine, the device comprising:

a drive element which is driven by the crankshaft via a gearwheel and which is mounted rotatably with respect to the camshaft, there being formed between the drive element and the camshaft, at least two hydraulic chambers which can be acted upon with a pressure fluid in order to set a defined relative rotary position between the drive element and the camshaft, wherein the drive element has at least one cover arranged on an end face, the gearwheel being axially adjacent to the cover and being connected to the cover positively by a flanged portion of the gearwheel.

3. The device according to claim 1, wherein the cover is connected to the drive element by means of a screw connection.

4. The device according to claim 2, wherein the gearwheel and the cover are connected to one another positively by a snap ring.

5. The device according to claim 4, wherein the snap ring is arranged in an annular recess formed by the flanged portion of the gearwheel.

6. The device according to claim 2, wherein the cover is connected to the drive element by means of a screw connection.

* * * * *